US005738422A

United States Patent [19]

Welborn, Jr. et al.

[11] Patent Number: 5,738,422

[45] Date of Patent: Apr. 14, 1998

[54] COMPUTER WORK STATION

[75] Inventors: Earl Dalton Welborn, Jr., Davidson County, N.C.; Henry Pyron Long, Jr., Henry County, Va.

[73] Assignee: Hooker Furniture Corporation, Martinsville, Va.

[21] Appl. No.: 728,436

[22] Filed: Oct. 10, 1996

[51] Int. Cl.[6] ..... A47B 87/00

[52] U.S. Cl. ..... 312/198; 312/196; 312/208.1; 312/9.51; 312/223.6

[58] Field of Search ..... 312/196, 195, 312/194, 223.6, 208.1, 198, 9.48, 9.51

[56] References Cited

U.S. PATENT DOCUMENTS

| | | | |
|---|---|---|---|
| D. 227,063 | 6/1973 | Allen . | |
| D. 303,881 | 10/1989 | Markus . | |
| D. 327,791 | 7/1992 | Lechman . | |
| D. 335,591 | 5/1993 | Lechman . | |
| D. 354,408 | 1/1995 | Kelly . | |
| 842,780 | 1/1907 | Gardner | 312/196 X |
| 1,880,733 | 10/1932 | Bohuis | 312/196 X |
| 4,272,136 | 6/1981 | Sengua | 312/196 |
| 4,323,291 | 4/1982 | Ball . | |
| 4,555,150 | 11/1985 | Turnbull . | |
| 4,712,842 | 12/1987 | Price et al. . | |
| 4,766,422 | 8/1988 | Wolters et al. . | |
| 4,792,881 | 12/1988 | Wilson et al. | 312/223.6 X |
| 4,852,500 | 8/1989 | Ryburg et al. . | |
| 5,255,966 | 10/1993 | Newhouse et al. | 312/107 |
| 5,346,296 | 9/1994 | Kelley | 312/198 |
| 5,429,431 | 7/1995 | Olson et al. | 312/223.6 |
| 5,472,269 | 12/1995 | Novikoff | 312/195 X |
| 5,474,373 | 12/1995 | Forester | 312/208.1 X |
| 5,558,418 | 9/1996 | Lambright et al. | 312/194 X |

FOREIGN PATENT DOCUMENTS

| | | | |
|---|---|---|---|
| 431207 | 4/1913 | France | 312/196 |
| 2650494 | 2/1991 | France | 312/194 |
| 15404 | 7/1901 | United Kingdom | 312/196 |

OTHER PUBLICATIONS

Hooker Furniture Corporation brochure No. 866–10–056, 057 and 058 for Hearthside Cherry Computer Work Station, May 1995.

Hooker Furniture Corporation brochure No. 838–70–056, 057 and 058 for Decorator Group Computer Work Station, Aug., 1990.

Hooker Furniture Corporation brochure No. 838–70–057, 058 and 060 for Decorator Group Computer Work Station, May, 1995.

Hooker Furniture Corporation brochure No. 572–10–004, 005 and 006 for Chalet Computer Work Station, Jun., 1996. The design featured in this brochure is subject to the design claimed in the design patent application Serial No. 29/056,393 which was filed on Jun. 27, 1996 and assigned to Hooker Furniture Corporation.

Hooker Furniture Corporation brochure No. 066–10–004, 005 and 006 for Decorator Group Computer Work Station, Jun., 1996. The design featured in this brochure is similar to the design claimed in the design patent application Serial No. 29/056,393 which was filed on Jun. 27, 1996 and assigned to Hooker Furniture Corporation.

*Primary Examiner*—Peter M. Cuomo
*Assistant Examiner*—Hank V. Tran
*Attorney, Agent, or Firm*—J. Michael Martinez de Andino; McGuire, Woods, Battle & Boothe LLP

[57] ABSTRACT

A computer work station has a first desk unit with a front tapered edge and has a cabinet with an electrical control panel with surge protected outlets, a first shelf unit and a second desk unit. The first shelf unit is placed on and connected to the top of the first desk unit and has two cabinets with computer disk and compact disk storage racks. The second desk unit has a bookcase, a desktop and a file cabinet. One end of the desktop is inserted into and supported by a support rail in the bookcase and the other end is placed upon and secured to the file cabinet. The second desk unit can be connected to either side of the first desk unit with the first shelf unit attached to the first desk unit. The second desk unit has shaped edges that form a shaped edge corner with the front shaped edge of the first desk unit.

16 Claims, 8 Drawing Sheets

COMPUTER WORK STATION

I. RELATED APPLICATIONS

This application is related to copending Design Patent application Ser. No. 29/056,393 for a COMPUTER WORK STATION filed on Jun. 27, 1996, the disclosure of which is incorporated herein in its entirety.

II. TECHNICAL FIELD

The present invention relates to desks or like units, and more particularly to a computer work station with electrical controls and versatility of file cabinet placement.

III. BACKGROUND OF THE INVENTION

There are desks or computer work stations that disclose office work stations which include a module having a desk inserted within the module, such as in U.S. Pat. No. D303,881. There are also desks that have electrical wiring ducts, or work stations that have a movable storage cabinet that can be stored under the work stations' table top, such as in U.S. Pat. Nos. 4,323,291 and 4,555,150, respectively. Additionally, there are computer work processing systems that have several supporting surfaces located within a housing for supporting computer components, such as in U.S. Pat. No. 4,712,842, or that have a visual display terminal concealed within the desktop, such as U.S. Pat. No. 4,766,422. These prior art desks or work stations, however, do not have nor use a work station that have computer disc storage racks located within the inside of the work stations' cabinet, nor that have several electrical outlets with surge protection and an electrical control master switch for controlling the electrical operation of equipment connected to or installed within the desk or work station. Additionally, the above-mentioned prior art does not include or use a bookcase with a desk and file cabinet that can be movably positioned and connected to the left or right side of the computer desk or work station's table top. Accordingly, there is a need for a computer work station with electrical controls and the versatility of the placement of a bookcase with a desk and file cabinet.

In order to overcome the above-mentioned defects in the previously known desks and computer work stations, there is a need for a computer work station that can be used in the home or in the office and that has a computer desk with a control panel with surge protected outlets and telephone jacks installed within the desk, and which has a bookcase with a desk and file cabinet that can be movably positioned and connected to the left or right side of the desk. The computer work station of the present invention meeting these requirements is described in more detail below.

IV. SUMMARY OF THE INVENTION

In accordance with the present invention, the disadvantages of the prior desks and computer work stations has been overcome. The computer work station of the present invention is designed for use in the home as an elegant and functional piece of furniture, as well as for use in the office.

According to the present invention, the computer work station of the present invention consists of a computer desk or a first desk unit that is connected to a hutch or a first top shelf unit and to a bookcase with a desk and file cabinet, referred to as the second desk unit. The first desk unit has a lower cabinet shelf that has an electrical control panel installed in the lower cabinet. The first top shelf unit has two top cabinet shelves with computer disk storage racks installed in the top cabinets. The first and second desk units each have first and second top surfaces that have a front shaped edge, while the second top surface has opposite sides with shaped edges. The shaped edges of the second top surface extend from the front shaped edge to approximately two-thirds the distance of the opposite sides. The second desk unit is adapted to be placed on either side of the first desk unit, thereby providing a computer work station with a bookcase with a desk and file cabinet that can be connected on the left or right side of the first desk unit, with the interior connection of the first and second top surfaces creating a shaped edge corner.

Accordingly, it is the primary object of the present invention to provide a computer work station that provides for a first desk unit with a first top shelf unit and a second desk unit that has a bookcase with a desk and file cabinet which can be placed on either side of the first desk unit.

It is a further object of the present invention to provide a computer work station that provides for a first desk unit with a first top shelf unit and a second desk unit that has a bookcase with a desk and file cabinet that can be placed on either side of the first desk unit, and which has an electrical control panel, telecommunication connections and computer disk storage racks installed within the first desk unit and the first top shelf unit. Other objects and advantages of this invention will become apparent from the following description wherein is set forth, by way of illustration and example, certain embodiments of this invention.

V. BRIEF DESCRIPTION OF THE DRAWINGS

VI. DETAILED DESCRIPTION OF THE PREFERRED EMBODIMENTS

Figure 1:
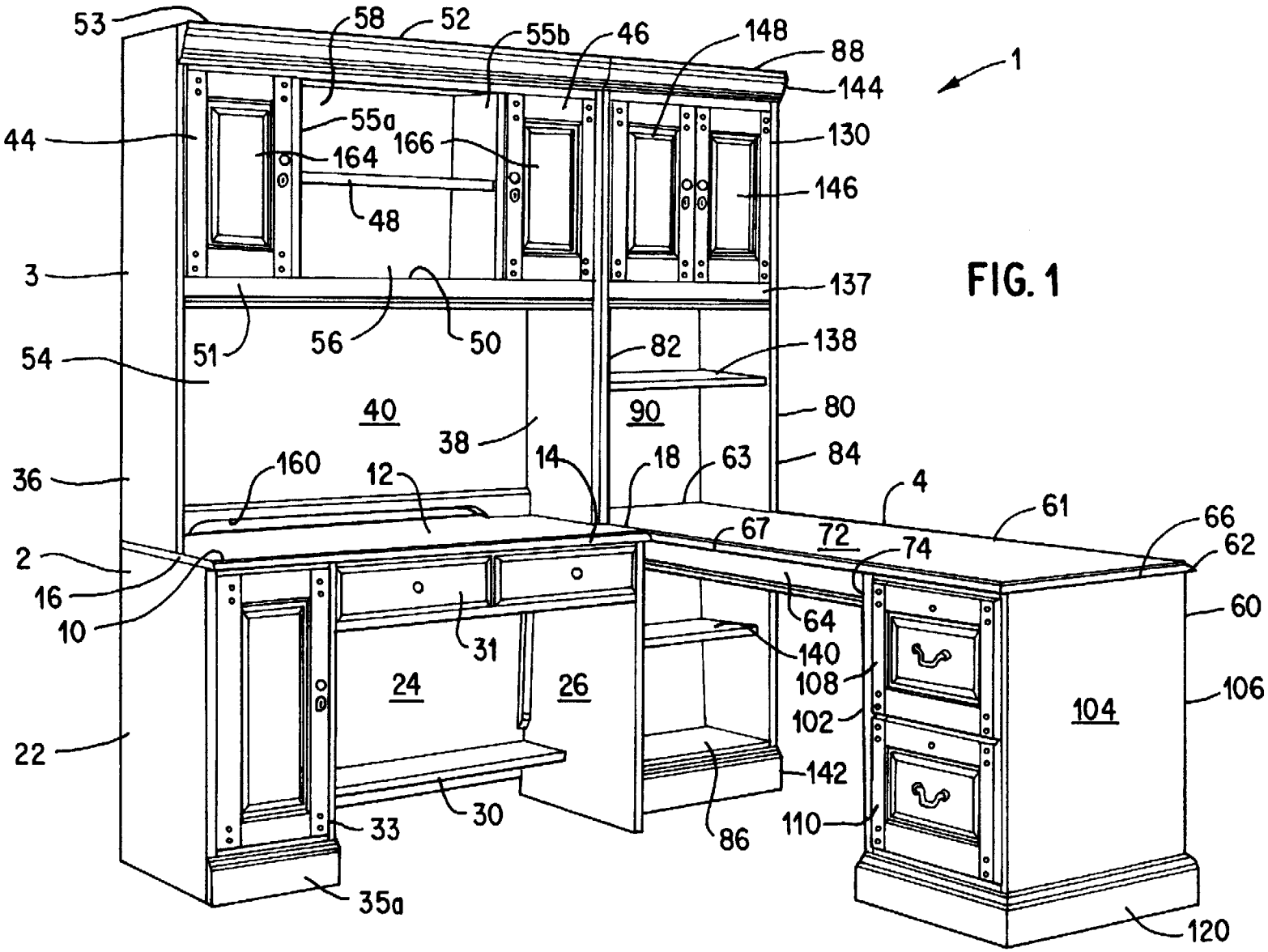
FIG. 1 is a perspective view of the computer work station that has the bookcase with a desk and file cabinet connected to the right side of the computer desk.

Referring now to the drawings, a typical embodiment of the invention is shown in FIGS. 1–7. Before the present invention is described, however, it is to be understood that this invention is not limited to a particular or specific description. It is also to be understood that the terminology used herein is for the purpose of describing particular embodiments only, and is not intended to be limiting, as the scope of the present invention will be limited only by the appended claims. Further, unless defined otherwise, all terms used herein have the same meaning as commonly understood by one of ordinary skill in the art to which this invention belongs.

Referring to FIGS. 1–7, a computer work station 1 is shown being comprised of a first desk unit 2 that is connected to a first top shelf unit 3 and to a second desk unit 4. The first desk unit 2 has a rectangular top 10 with a top surface 12, a front shaped edge 14, and opposite sides 16 and 18. The top 10 is supported by a first cabinet 22, having an outer side wall 22*a* spaced apart from the inner side wall 22*b* a first vertical back panel 24 and a first vertical side panel 26. The first cabinet 22 is positioned apart and separated from the first vertical side panel 26 by a lower shelf 30, a drop down front panel 31 with a pull out keyboard tray 32. The first cabinet 22 has a first cabinet door 33 and an adjustable and removable first shelf 34. The first back vertical panel 24 has three cut out openings (not shown) for ventilation and one grommet (not shown) for electrical wire management that are located inside the first cabinet 22 adjacent to the bottom panel 35 of the first cabinet 22. Attached across the front bottom of the first cabinet 22 is a bottom edge trim 35*a*.

The first top shelf unit 3, also referred to as a hutch, has spaced apart second and third vertical side panels 36 and 38 that are connected to a second vertical back panel 40, and has spaced apart second and third cabinets 44 and 46 that are connected to a top shelf 48. The second and third cabinets 44 and 46 are connected to the second and third vertical side panels 36 and 38, respectively, and to the second vertical back panel 40. The second and third cabinets 44 and 46 are also connected to a support shelf 50 that is connected to and located approximately midway along the length of the second and third vertical side panels 36 and 38, respectively, and the second vertical back panel 40, with top ends of the second and third cabinets 44 and 46 being connected to a top panel 52. A working area 54 is created by the space formed by the second and third vertical side panels 36 and 38, the second vertical back panel 40, the bottom surface of the support shelf 50 and the top surface 12 of the rectangular top 10. The spaces formed by the top surface of the support shelf 50, the spaced apart cabinet walls 55*a* and 55*b* of the second and third cabinets 44 and 46, respectively, the bottom surface of the top panel 52, and the top shelf 48 form first and second storage areas 56 and 58. The top panel 52 has a top edge trim 53 connected to the front surface of the top panel 52. The support shelf 50 has a first rail trim 51 connected to the front surface of the support shelf 50.

The second desk unit 4 has a file cabinet 60, a desktop 61 and a bookcase 80. As shown in FIGS. 1–7, the desktop 61 has first and second spaced apart ends 62 and 63, spaced apart first and second sides 64*a* and 65*a* and spaced apart first and second horizontal side panels 64 and 65 that are attached to the bottom surface of the desktop 61. The first and second horizontal side panels 64 and 65 have first and second side panel ends 74 and 76, respectively. The first and second horizontal side panels 64 and 65 extend along the sides 64 and 65*a*, respectively of the desktop 61 from the second end 63 to approximately two-thirds the length of the desktop 61, terminating at first and second side panel ends 74 and 76.

The desktop 61 also has a desktop surface 72 that has a front shaped edge 66 and spaced side apart first and second shaped side edges 67 and 68. The first and second shaped side edges 67 and 68, respectively, extend out beyond the desktop surface 72 and the first and second horizontal side panels 64 and 65, respectively. The front shaped edge 66 extends out beyond the desktop surface 72 near first end 62.

Figure 6:
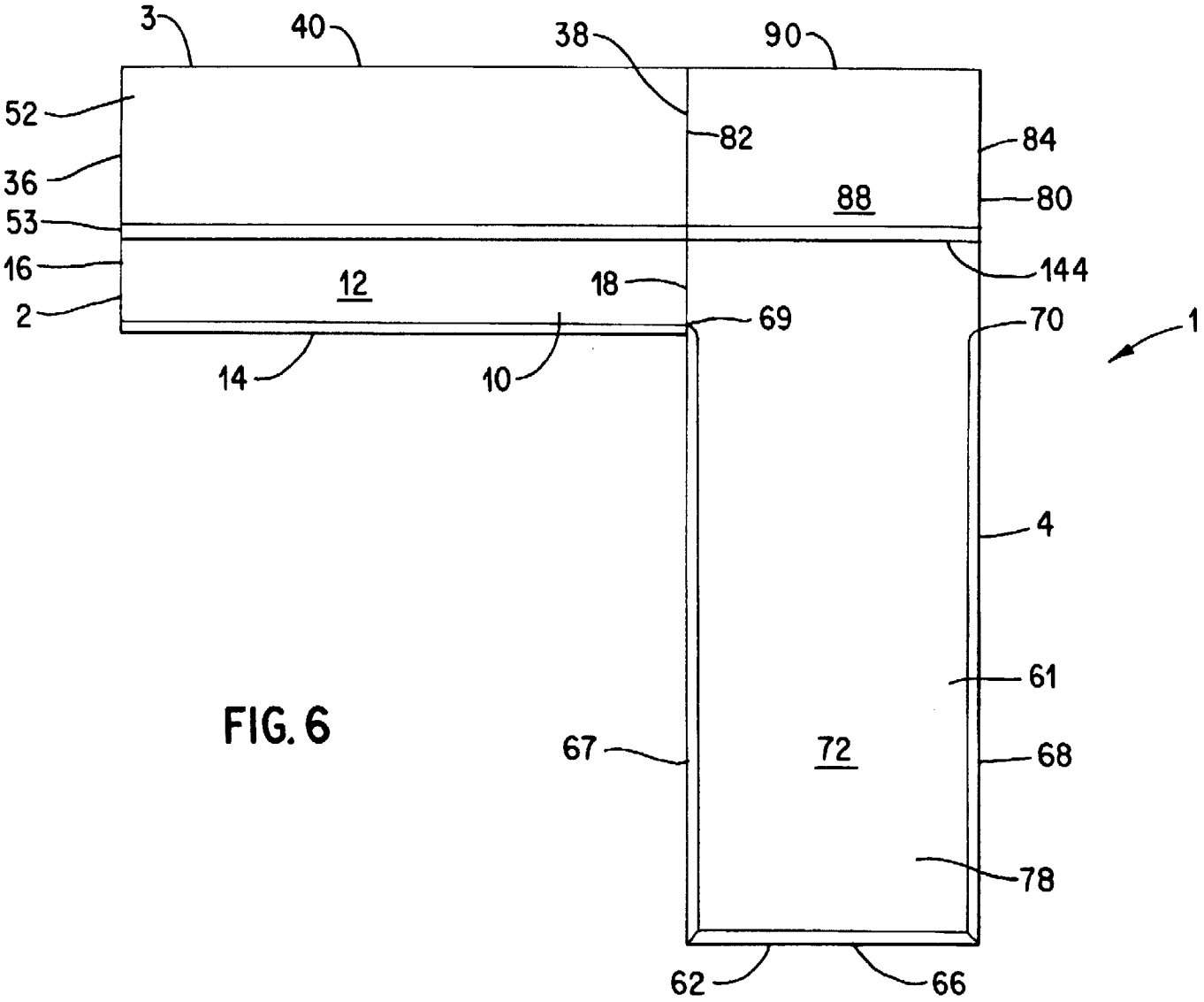
FIG. 6 is a top plan view of the computer work station shown in FIG. 1.
Figure 7:
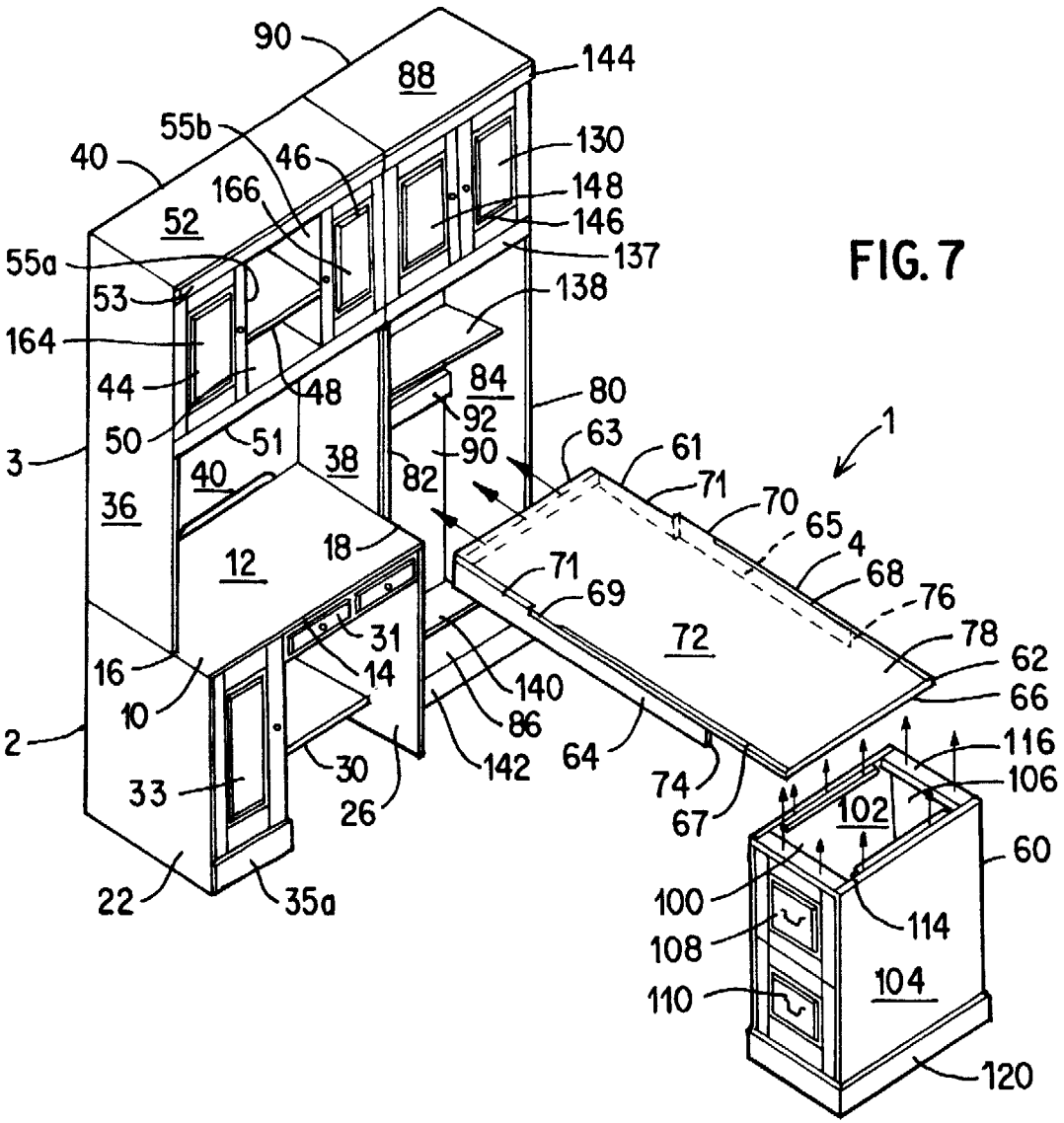
FIG. 7 is a partial segmented perspective view of the computer work station shown in FIG. 1.
Figure 8:
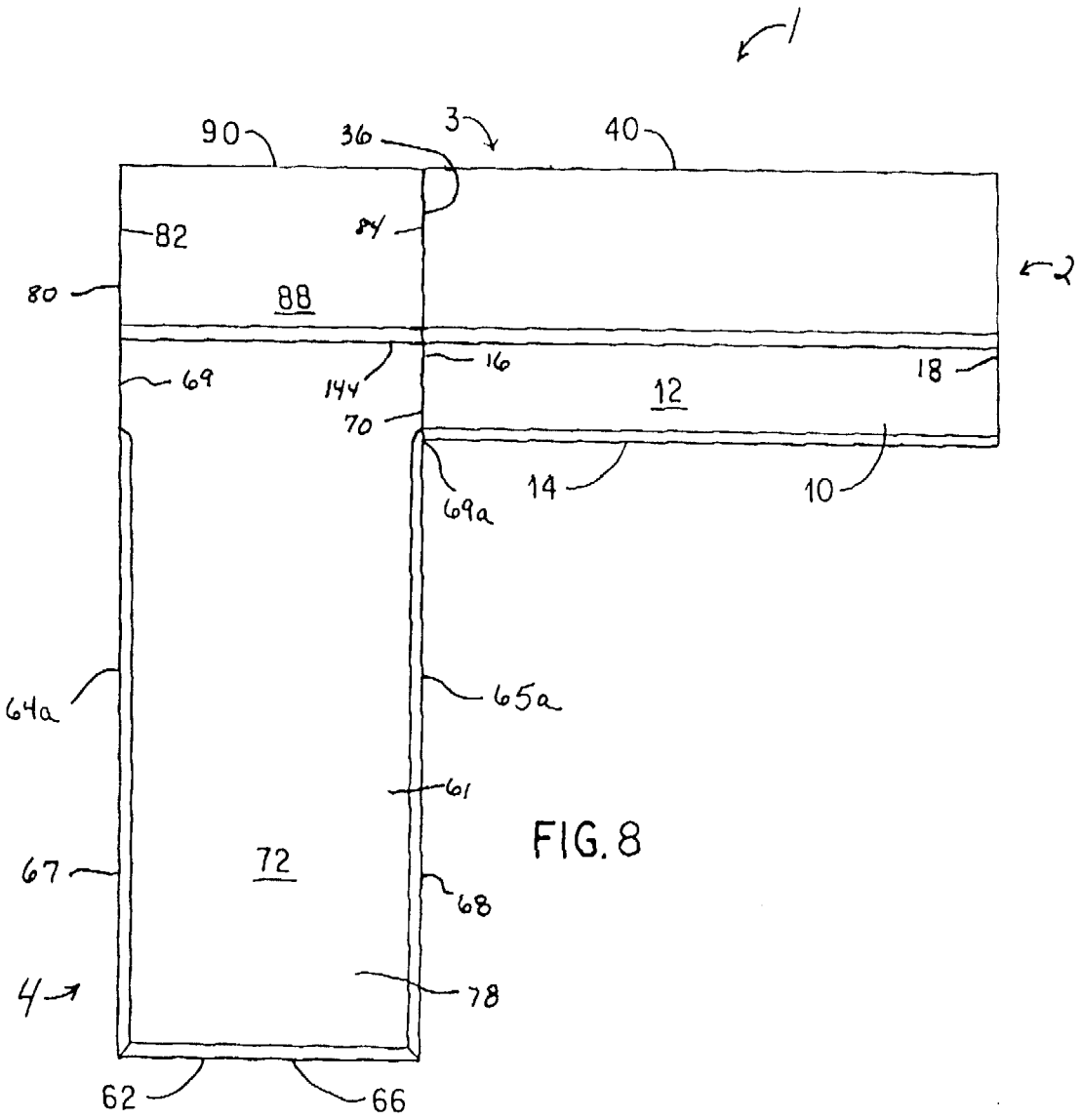
FIG. 8 is a top plan view of the computer work station that has the bookcase with the desk and file cabinet connected to the left side of the computer desk.
Figure 1:
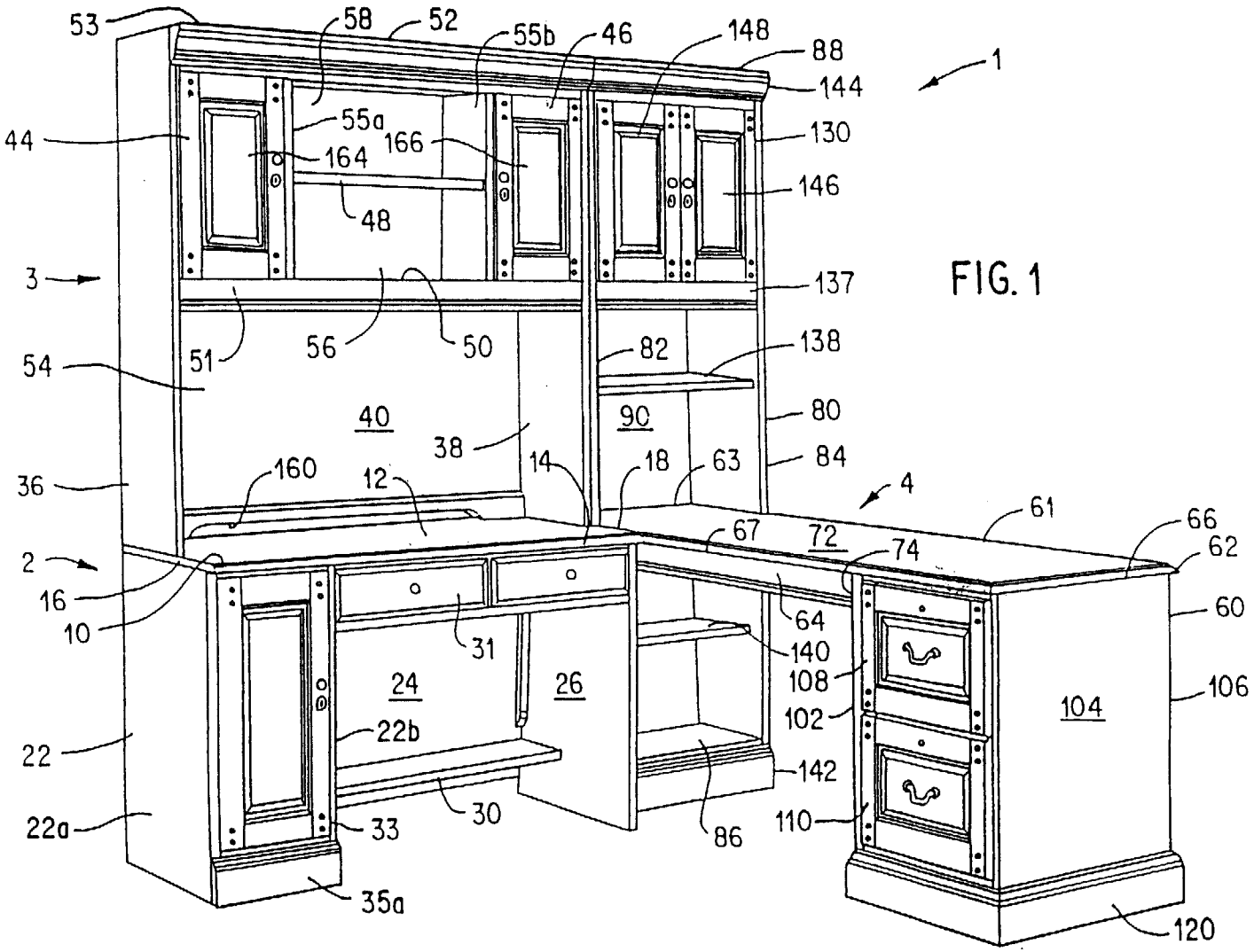
Figure 2:
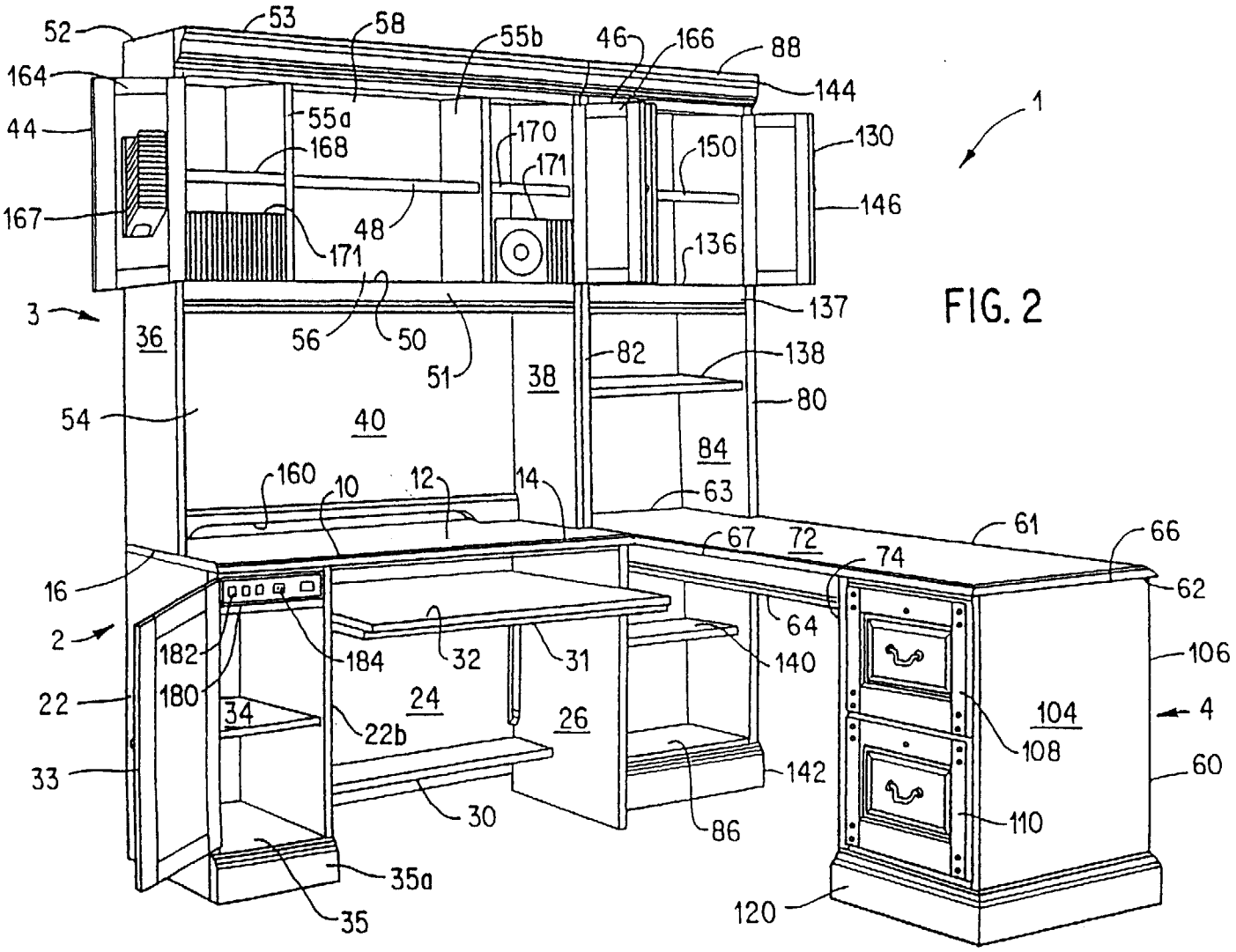
Figure 3:
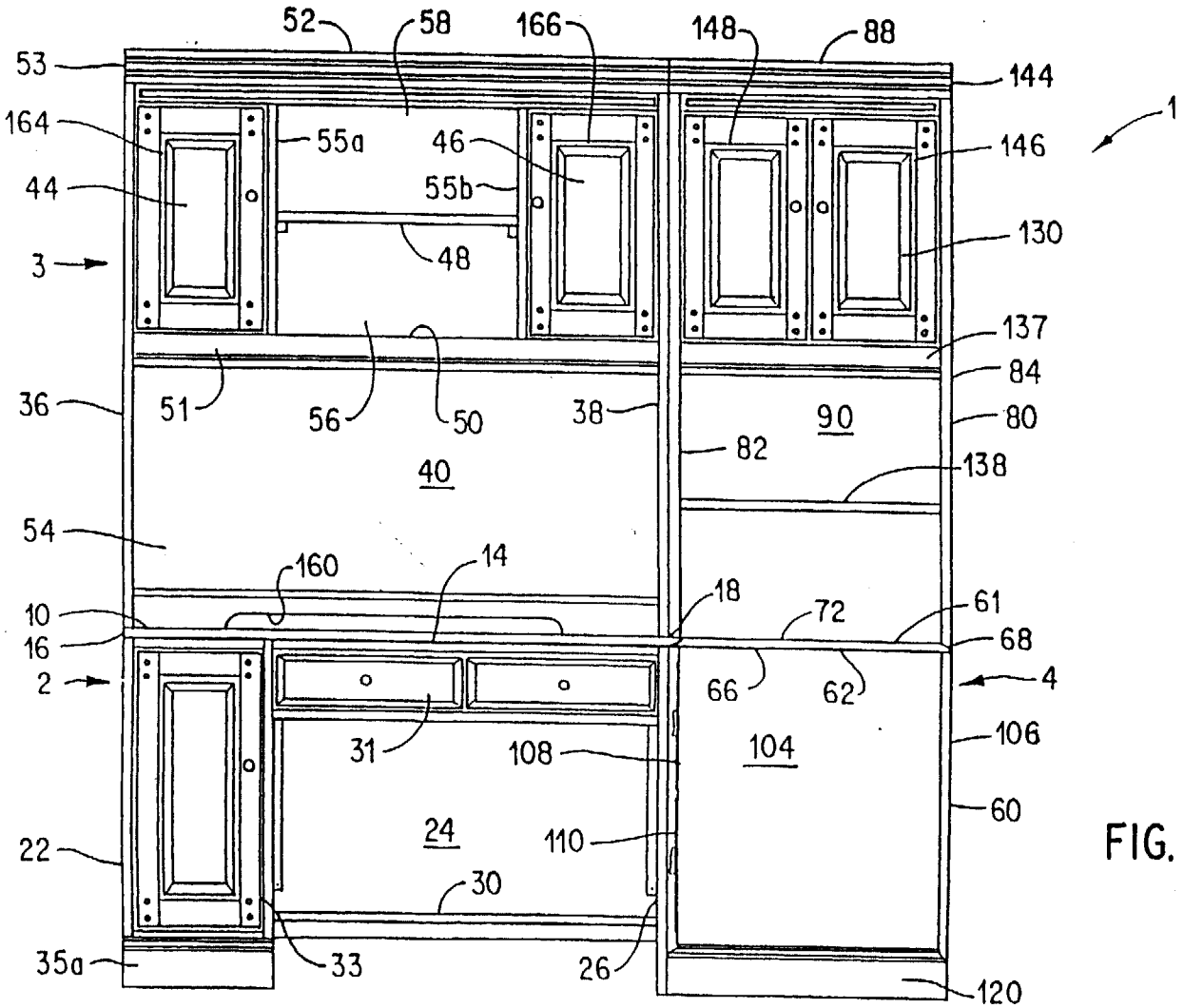
Figure 4:
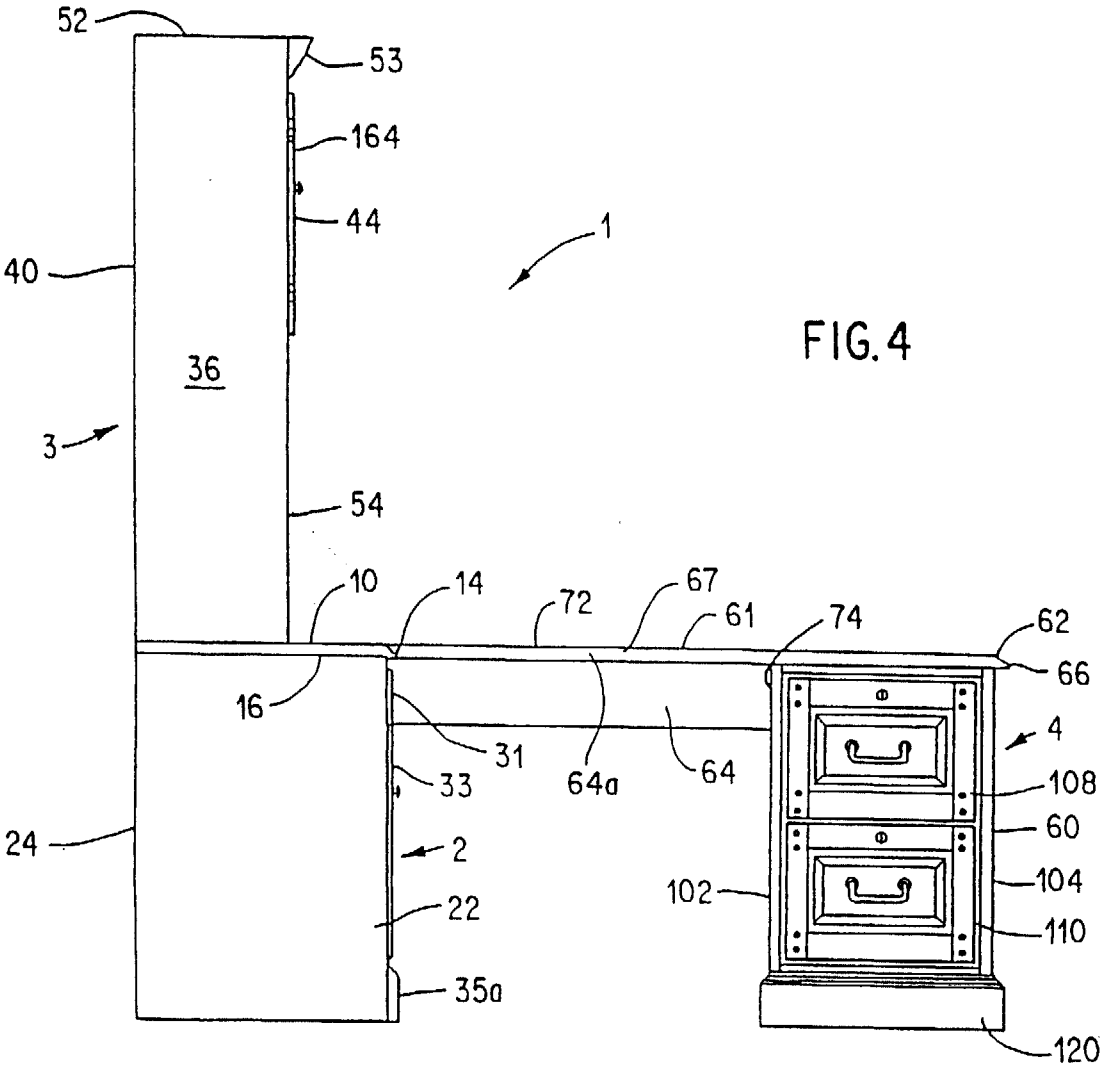
Figure 5:
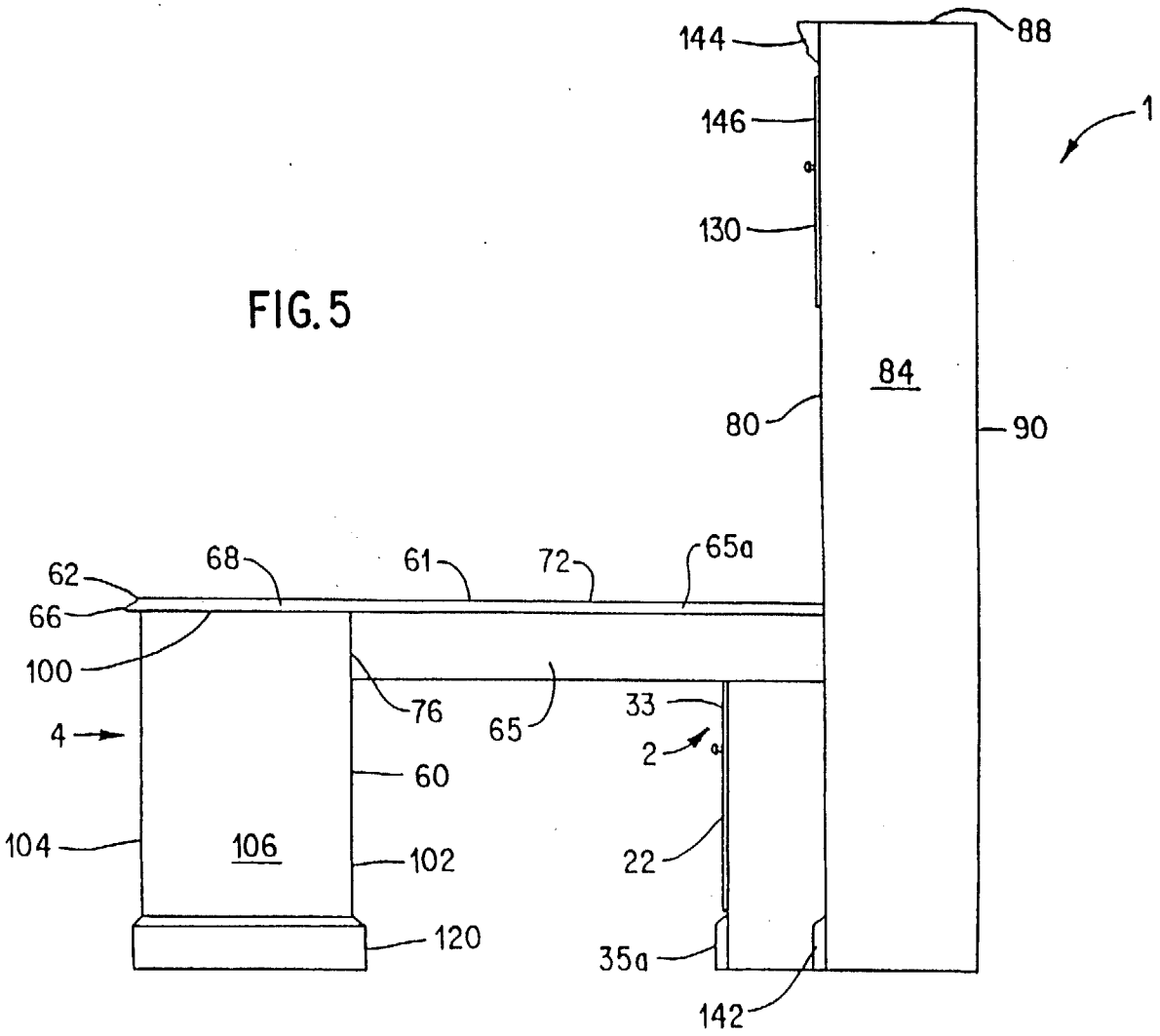
Figure 6:
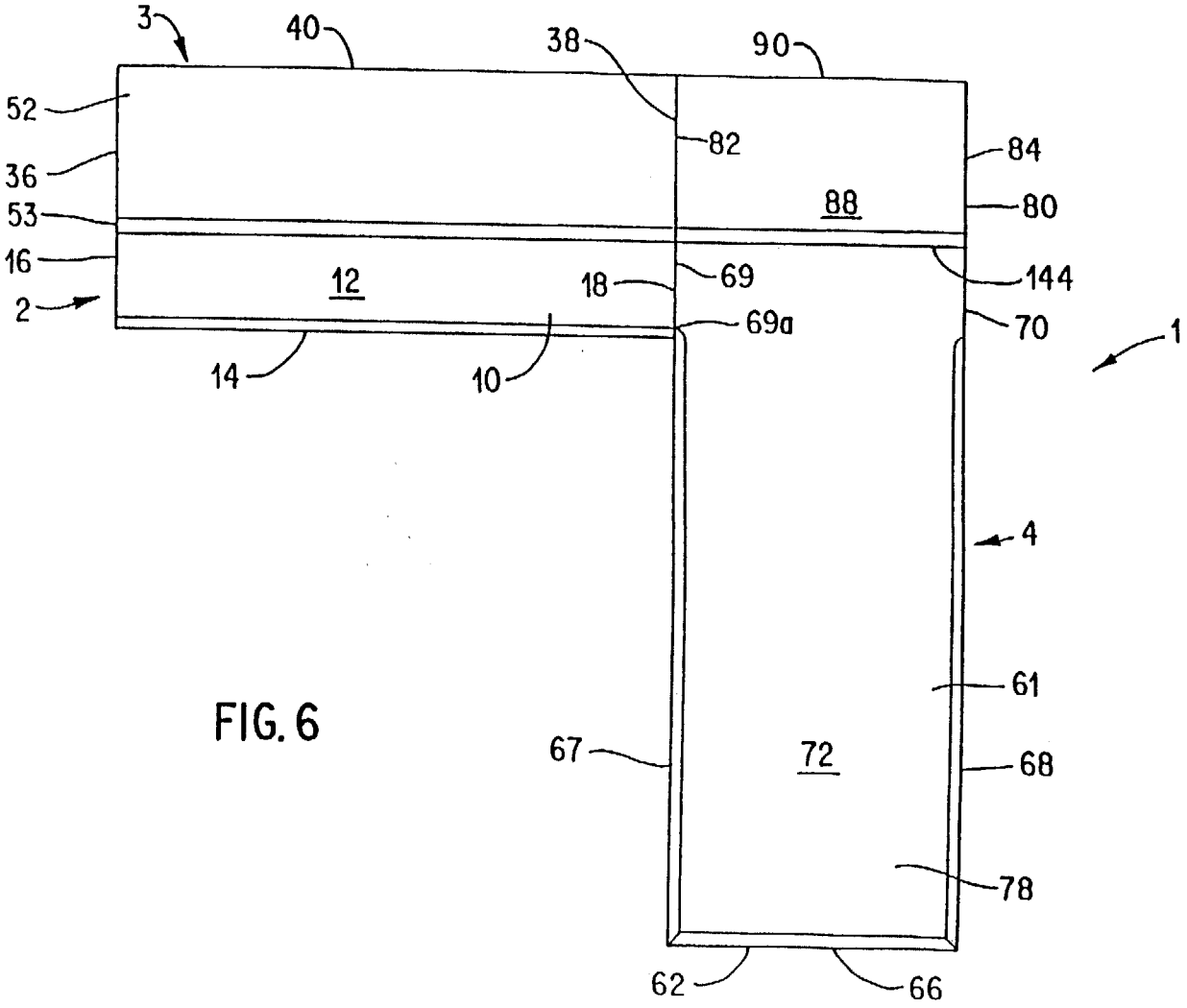
Figure 7:
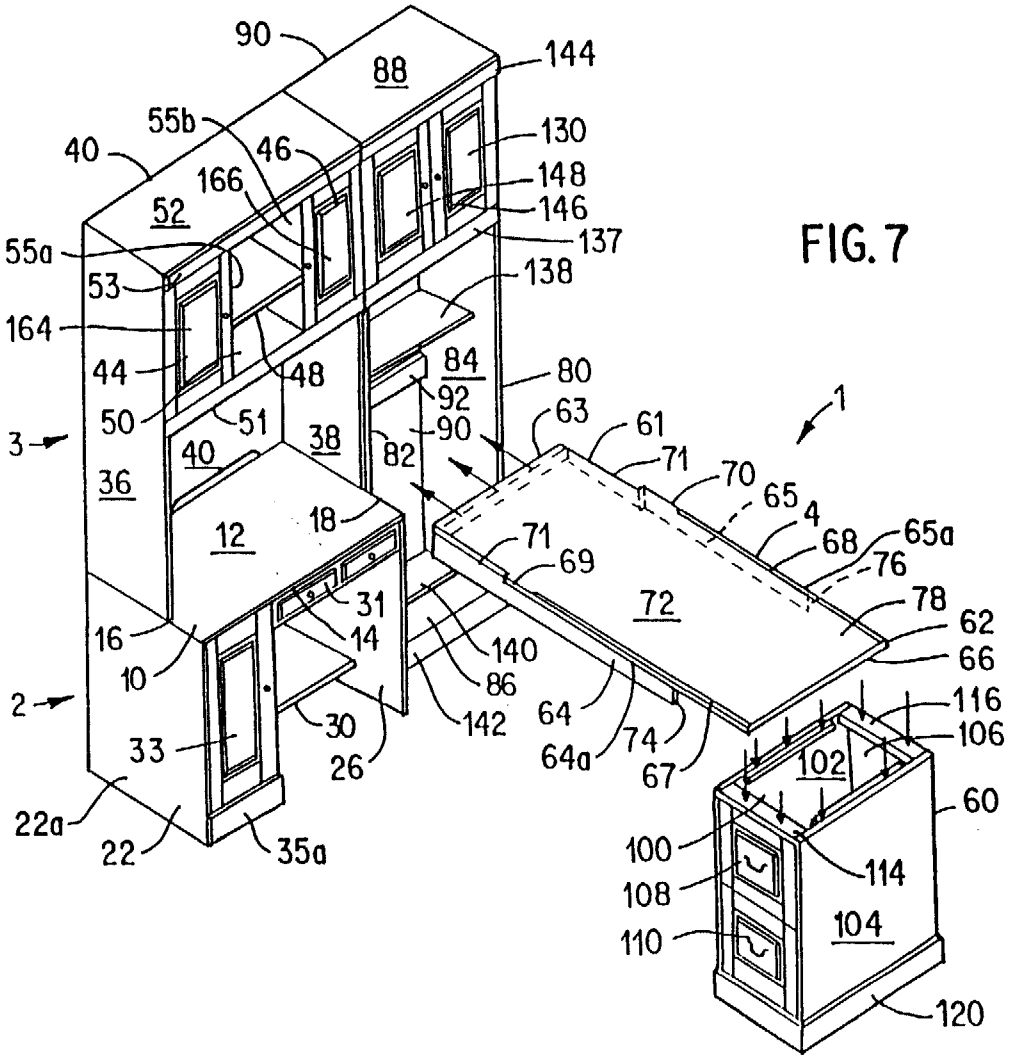
Figure 8:
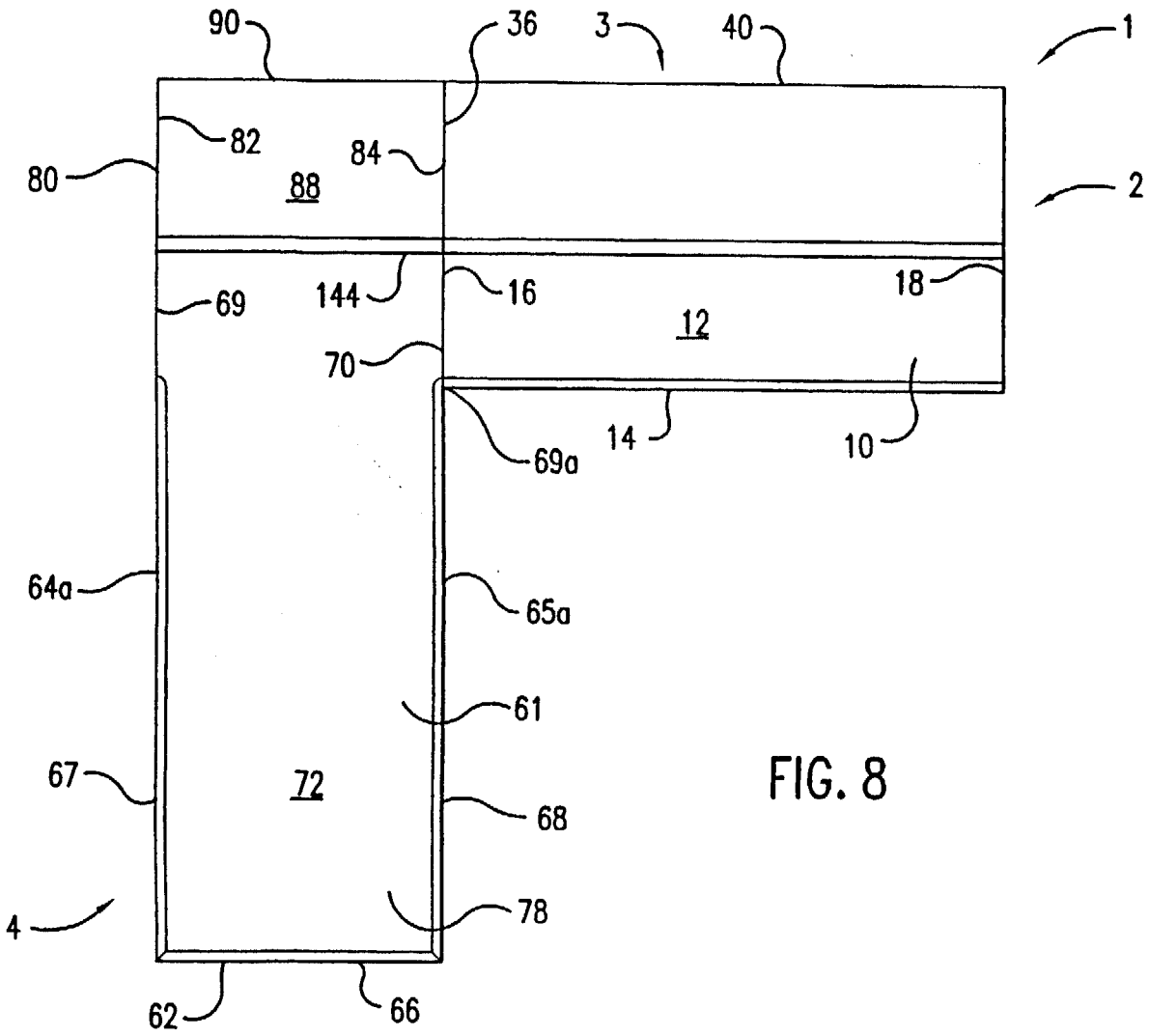

The first and second shaped side edges 67 and 68 extend along the sides 64*b* and 65*a*, respectively, of the desktop 61 from the front shaped edge 66 to approximately two-thirds the distance of the length of the desk top 61, where the first and second shaped side edges 67 and 68 become squared and loose the shaped appearance, shown at reference numerals 69 and 70, respectively, in FIGS. 6 7 and 8. The squared first and second side edges 69 and 70 extend along the length of the desktop 61 for approximately seven inches until an approximate one inch groove 71 is made into the sides 64 and 65*a* of the desktop 61 for the remaining length of the desktop 61, such that the groove 71 extends to the second end 63.

The bookcase 80 has spaced apart first and second bookcase walls 82 and 84 and spaced apart bookcase bottom and top panels 86 and 88 that are connected to the first and second bookcase walls 82 and 84 and to a back wall 90. As shown in FIGS. 2 and 7, the bookcase 80 also has a support rail 92 located approximately midway between the bottom and top panels 86 and 88 and is connected to the first and second bookcase walls 82 and 84, and the back wall 90. As shown in FIGS. 2 and 7, the desktop 61 is slid into the bookcase 80 until the second end 63 of the desktop 61 is placed upon and secured to the support rail 92. Simultaneously, the first end 62 of the desktop 61 is placed upon the file cabinet 60. As shown in FIGS. 1, 2, 4, 5 and 7, the desktop surface 72 has a rectangular surface extension 78 which extends beyond the first and second side panel ends 74 and 76. The surface extension 78 is placed upon the file cabinet 60 and covers the top surface area 100 of the file cabinet 60.

Referring to FIGS. 1–7, the file cabinet 60 has spaced apart first and second cabinet walls 102 and 104, a cabinet back wall 106 and two pull out locking file drawers 108 and 110 that have letter and legal file bars installed within the drawers 108 and 110 (not shown). As shown in FIG. 7, the first and second cabinet walls 102 and 104 are connected to the cabinet back wall 106 and to front and rear braces 114 and 116 to form the top surface area 100. The pull out drawers 108 and 110 are removably inserted and supported by the interior walls of the first and second cabinet walls 102 and 104. As illustrated in FIGS. 1–5 and 7, the file cabinet 60 also has a bottom edge trim 120 that is attached to the bottom outer surface ends of the first and second cabinet walls 102 and 104, the cabinet back wall 106 and across the bottom front surfaces of the first and second cabinet walls 102 and 104.

Referring now to the bookcase 80 and as shown in FIGS. 1–7, the bookcase 80 has a bookcase cabinet 130 that is located at the upper end of the bookcase 80 and is attached to the bookcase top panel 88 and to a bookcase support shelf 136. The bookcase support shelf 136 is connected to the first and second bookcase walls, 82 and 84 respectively and the back wall 90. The bookcase support shelf 136 has a second rail trim 137 connected to the front surface of the bookcase support shelf 136. The bookcase 80 also has bookcase first and second shelves 138 and 140 that are removably attached to the first and second bookcase walls 82 and 84 and to the back wall 90 such that the height placement of the shelves is adjustable. The bookcase first shelf 138 is located approximately two-thirds of the distance between the installed desktop 61 and the bookcase support shelf 136. The bookcase second shelf 140 is located approximately one-half of the distance between the bookcase bottom panel 86 and the underside of the desktop 61.

The bookcase 80 also has a bookcase bottom edge trim 142 that is attached across the front ends of the first and second walls 82 and 84 and along the front surface of the bookcase bottom panel 86. A top edge trim 144 is attached to the front surface of the bookcase top panel 88 and the first and second bookcase walls 82 and 84, and is located immediately above the bookcase cabinet 130. The back wall 90 has two grommets or openings (not shown) for electrical/ wire management, such as for a printer, that are located near the second end 63 of the desktop when the desktop 61 is inserted into the bookcase 80.

As shown in FIGS. 1–3 and 7, the bookcase cabinet 130 has bookcase cabinet doors 146 and 148, and a removable and adjustable bookcase shelf 150. The bookcase 80 also has a first light fixture (not shown) that is attached to the bottom surface of the bookcase support shelf 136 and is located near the front surface of the bookcase support shelf 136, behind the second rail trim 137.

As discussed in more detail and as shown in FIGS. 1–3 and 7, the second vertical back panel 40 of the first top shelf unit 3 has a cut out area 160 centrally located at the bottom end of the second vertical back panel 40 and immediately adjacent to the top surface 12 of the rectangular top 10. The cut out area 160 allows for electrical cords and other connections to pass through the cut out area 160. Located immediately adjacent to the front surface of the support shelf 50, behind the first rail trim 51 and attached to the bottom surface of the support shelf 50 are second and third light fixtures (not shown) that are evenly spaced from one another for illuminating the working area 54.

Figure 2:
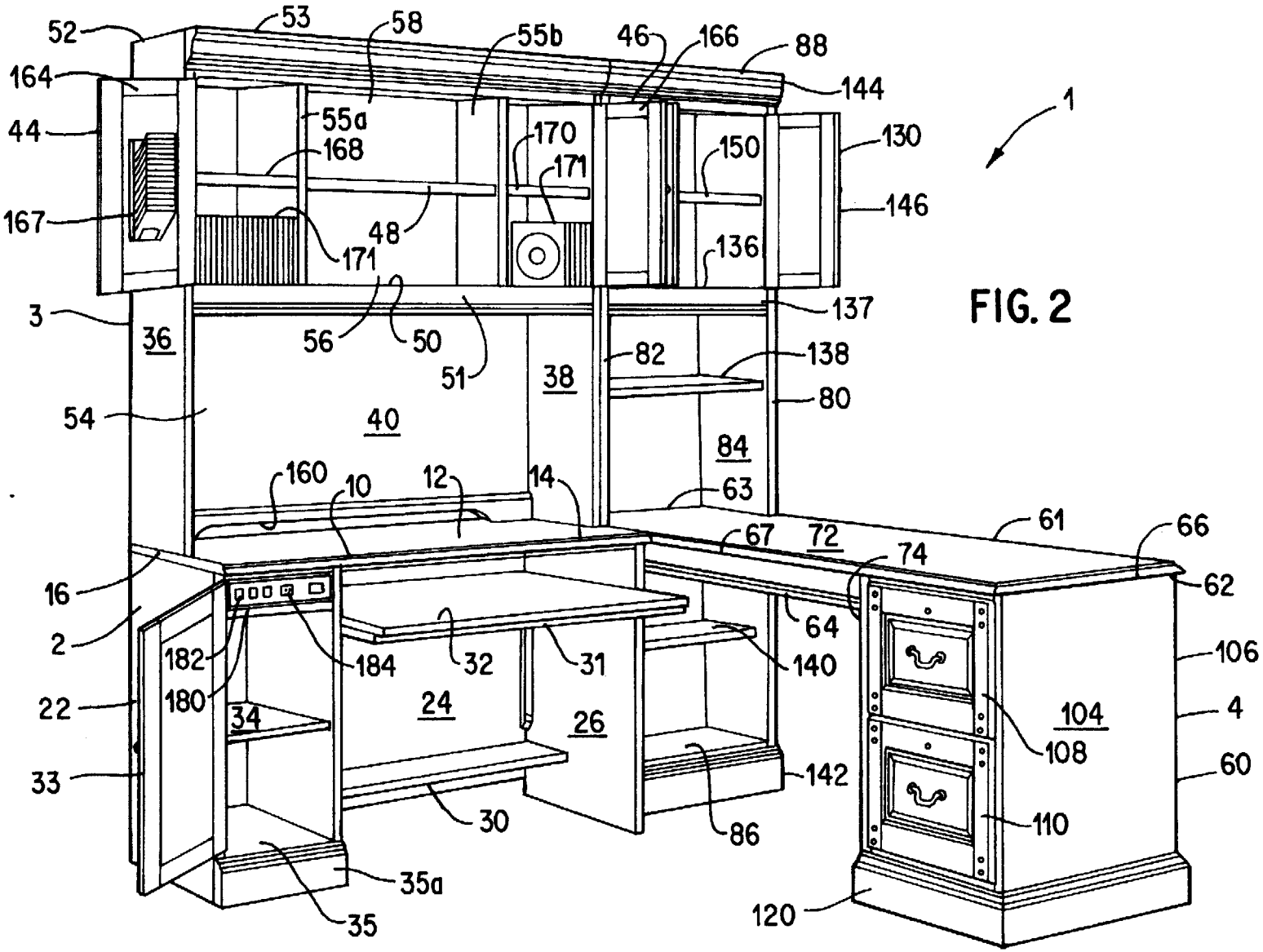
FIG. 2 is a perspective view of the computer work station with the cabinet doors open.
Figure 3:
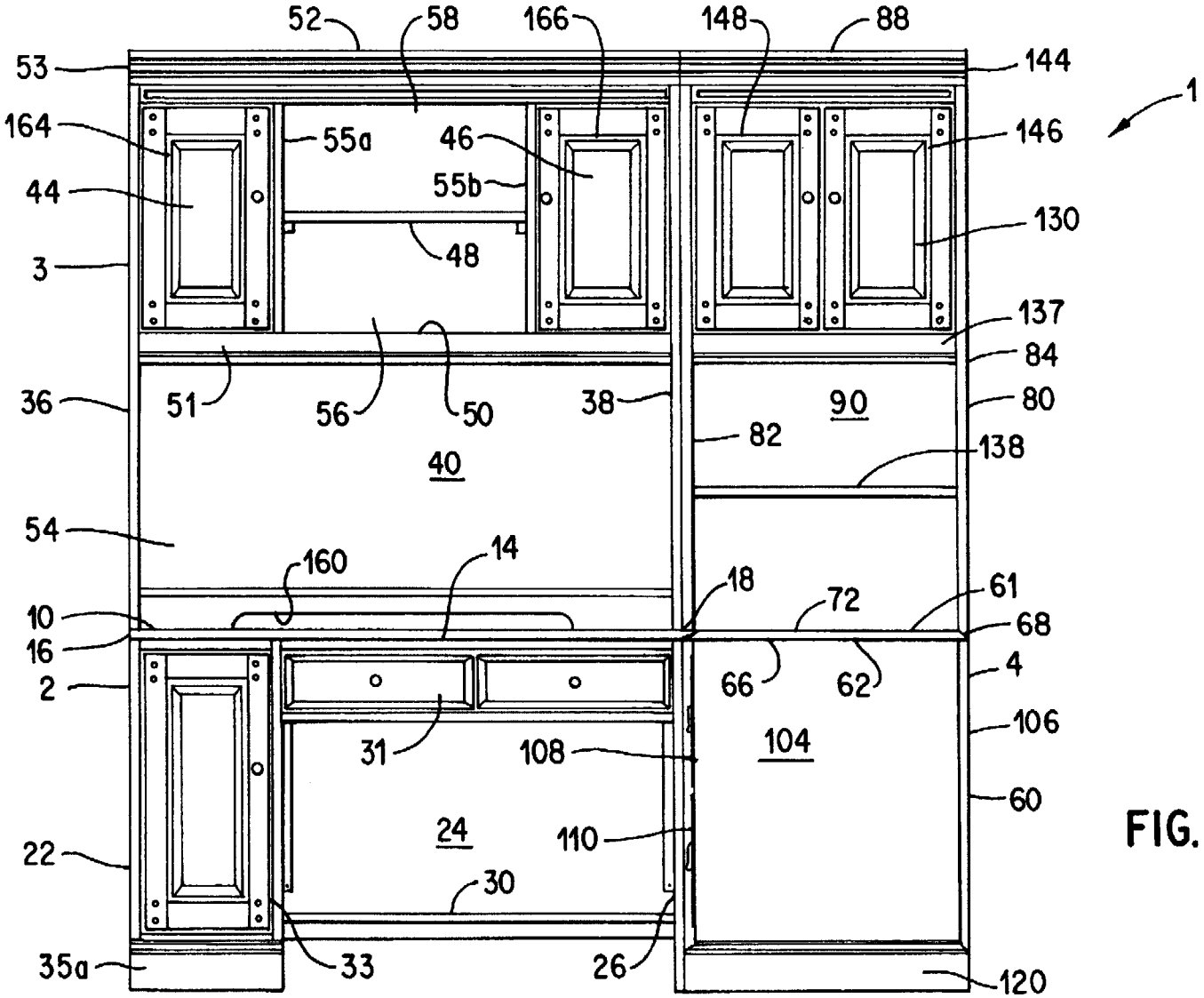
FIG. 3 is an elevational front view of the computer work station depicted in FIG. 1.
Figure 4:
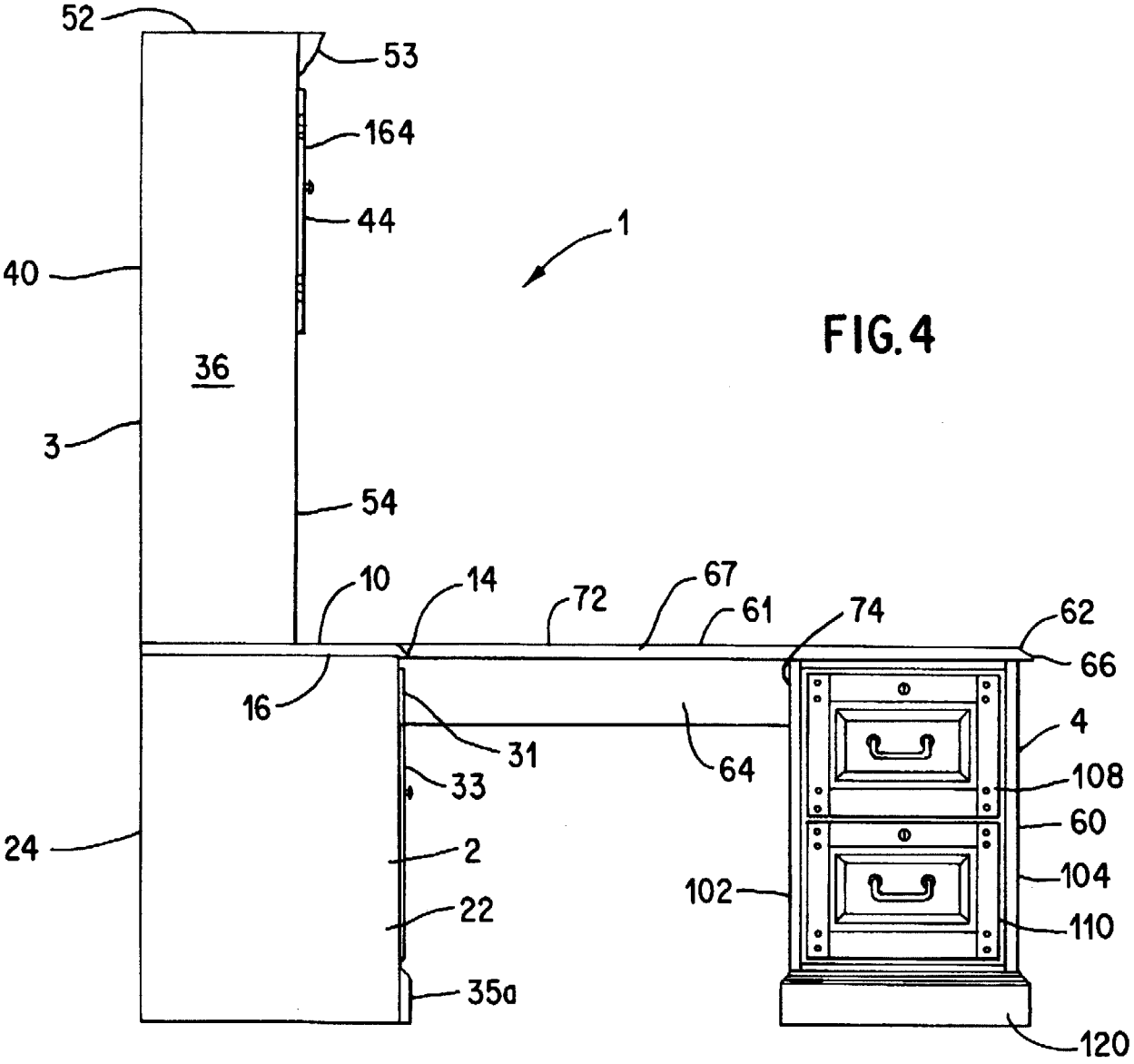
FIG. 4 is the left side view of the computer work station depicted in FIG. 1.
Figure 5:
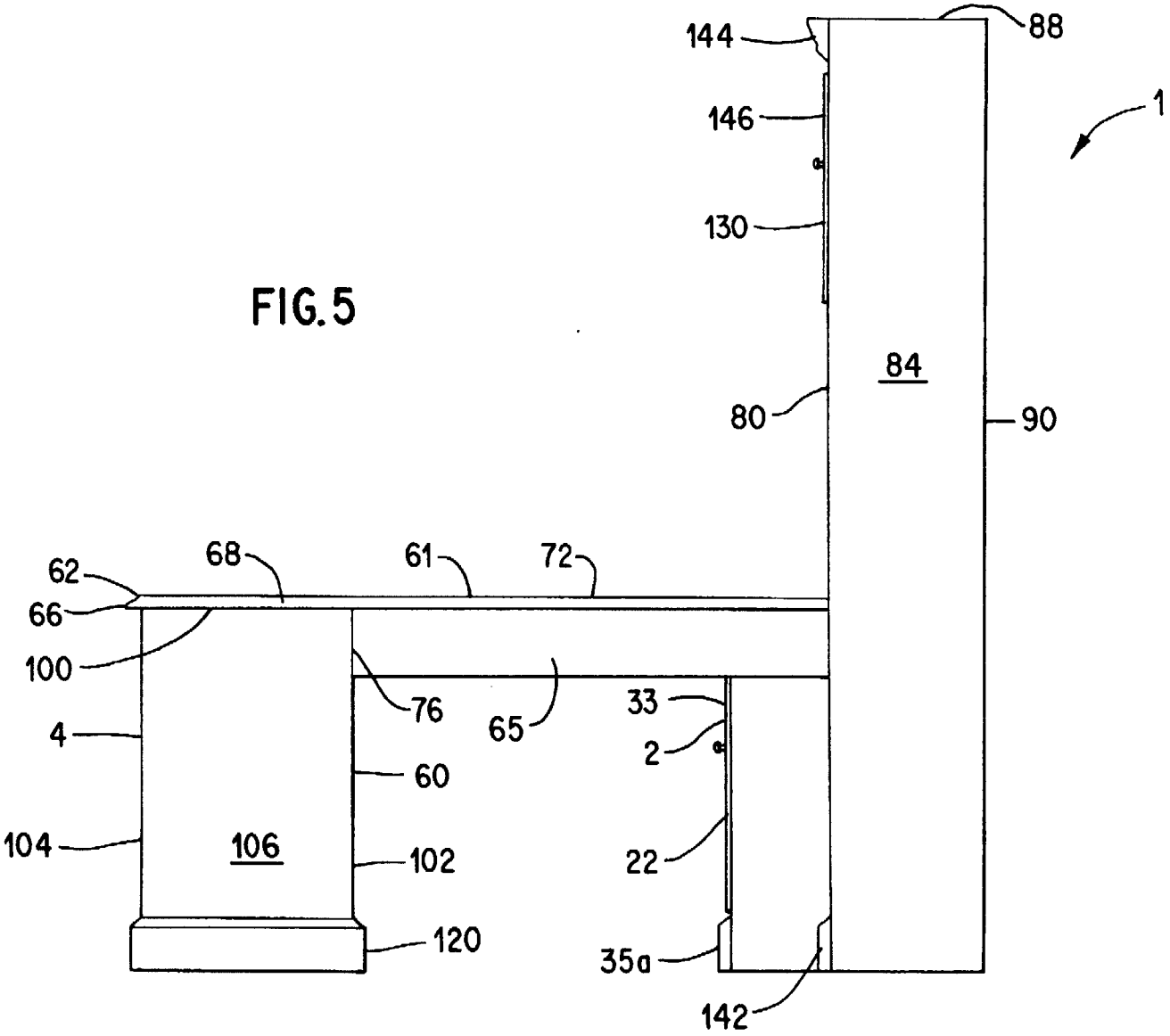
FIG. 5 is a right side view of the computer work station depicted in FIG. 1.

Referring now to FIGS. 1–3, the spaced apart second and third cabinets 44 and 46 have second and third cabinet doors 164 and 166, respectively, with the second cabinet door 164 having a computer disk rack 167 attached to the inside of the second cabinet door 164, thereby providing computer disk storage facilities. Additionally, the second and third cabinets 44 and 46 have removable and adjustable second and third shelves 168 and 170, respectively. Further, the top shelf 48 is also removable and adjustable thereby increasing or decreasing the first and second storage areas 56 and 58. As shown in FIG. 2, the second and third cabinets 44 and 46 also have compact disk racks 171 located within each of the cabinets and attached to the support shelf 50. The computer disk racks 171 can hold approximately 22 compact disks on each rack.

Referring to FIG. 2, the cabinet 22 of the first desk unit 2 has an electrical control panel 180 attached to the front bottom surface of the rectangular top 10. The electrical control panel 180 has four surge protected outlets that are electrically controlled by switches 182, a master control switch 184 and at least one phone jack (not shown) for connecting computer and telephone equipment thereto.

VII. SUMMARY

The computer work station 1 is comprised of a first desk unit 2 that has a first cabinet 22 with an adjustable and removable first shelf 34, an electrical control panel 180 with surge protected outlets 182, a master control switch 184 and telephone jacks, with the ability to store and connect a mini-tower computer processing unit within the first cabinet 22. The first desk unit 2 also has a drop down front panel 31 with a pull out keyboard tray 32, and a storage shelf 30. Located on top of the first desk unit 2 is a first shelf unit 3 that has spaced apart second and third cabinets 44 and 46 with second and third cabinet doors 164 and 166, respectively, with the second cabinet door 164 having a computer disk rack 167 attached to the inside of the cabinet door. Additionally, the second and third cabinets 44 and 46 have compact disk racks 171 and removable and adjustable second and third shelves 168 and 170, respectively. Second and third lighting fixtures are installed and mounted onto the front bottom surface of the support shelf 50 for illuminating the work station 54. A cut out area 160 in the first back vertical panel 24 is also provided for placing electrical power cords through the cut out area. The first shelf unit 3 can be attached to the first desk unit 1 through the use of clamps or other attaching means.

Placed and able to be connected to either side (left or right) of the first desk unit 2 and the first shelf unit 3 is a second desk unit 4 that includes a file cabinet 60, a desktop 61 and a bookcase 80. The desktop 61 has spaced apart first and second ends 62 and 63, with the second end 63 being inserted into the bookcase 80 such that the second end 63 is attached to and supported by the bookcase support rail 92. The desktop 61 has spaced apart first and second sides 64 and **65*a* with grooves 71 located near the second end 63 such that when the desktop 61 is inserted into the bookcase 80, the grooves 71 are placed immediately adjacent to the spaced apart first and second walls 82 and 84 of the bookcase 80. Further as shown in FIGS. 6 and 8, the sides of the desktop 61 have first and second shaped side edges 67 and 68 respectively 64*a* and 65*a* that when the desktop 61 is placed within the bookcase 80 and the bookcase 80 is placed adjacent to the first desk unit 2 and the first shelf unit 3, the first and second shaped side edges 67 and 68 create a shaped edged corner 69*a* with the front shaped edge 14 of the first desk unit 2. Additionally, the file cabinet 60 is placed underneath the desktop 61 near the first end 62 of the desktop 61 such that the first and second side panel ends 74 and 76 are immediately adjacent to the first cabinet wall 102. The desktop 61 is attached to the file cabinet 60 through the use of screws or other attaching means that are connected to rails and cleats located immediately inside and near the top surface 100 of the file cabinet 60**.

It is to be understood while certain forms of this invention have been illustrated and described, the invention is not limited thereto, except insofar as such limitations are included in the following claims.

What is claimed and described to be secured by letters patent is as follows:

1. A work station comprising:

a. a first desk unit having a first desktop, an outer side wall spaced apart from a first vertical side panel, and a first vertical back panel that is connected to the rear surfaces of the outer side wall and the first vertical side panel, the first desktop having a top surface with a front shaped edge;

b. a shelf unit located immediately above the first desktop and having spaced apart second and third vertical side panels that are connected to a second vertical back panel and a top panel; and c. a second desk unit having a file cabinet having spaced apart first and second file cabinet walls, a second desktop and a bookcase, the second desktop having spaced apart first and second ends, and spaced apart first and second sides, the first and second sides and the first end having first, second and third shaped edges, respectively, the first and second shaped edges extending from the first end along the first and second sides, respectively, and terminating at first and second squared edges of the first and second sides, respectively, the first and second squared edges extending further along the first and second sides, respectively, until terminating at first and second grooved sections of the first and second sides, respectively, the first and second grooved sections extending along the first and second sides until terminating at the second end, the second end and the first and second grooved sections of the second desktop being inserted into the bookcase, wherein the bookcase has first and second bookcase walls, a bookcase back wall, a bookcase top panel, and a rail that is attached to the inside surface of the bookcase back wall, the first and second bookcase walls being connected to the bookcase back wall and to the bookcase top panel, the second end of the second desktop being placed upon the rail and the first end of the second desktop being placed upon the file cabinet.

2. The work station as in claim 1, wherein the first bookcase wall of the second desk unit is placed against and connected to the third vertical side panel, and the front shaped edge of the first desk unit and the first shaped edge of the second desk unit create a first shaped corner edge.

3. The work station as in claim 1, wherein the second bookcase wall of the second desk unit is placed against and connected to the second vertical side panel, and the front shaped edge of the first desk unit and the second shaped edge of the second desk unit create a second shaped corner edge.

4. The work station as in claim 1, wherein the first desk unit has an electrical control panel mounted on the underside of the first desktop.

5. The work station as in claim 1, wherein the first desktop has an enclosure means and a hinged front panel for closing the enclosure means.

6. The work station as in claim 1, wherein the shelf unit has spaced apart first and second shelf unit cabinets that are connected to the bottom surface of the top panel, the first and second shelf unit cabinets being separated by an adjustable and removable shelf.

7. The work station as in claim 1, wherein the bookcase has a bookcase cabinet with an adjustable and removable bookcase cabinet shelf, the bookcase cabinet located below the bookcase top panel and above the rail.

8. A work station comprising:

a. a first desk unit having a first desktop mounted on a first cabinet having an outer side wall, a first vertical side panel spaced apart from the first cabinet and a first vertical back panel that is connected to the rear surfaces of the first cabinet and the first vertical side panel, the first desktop having a top surface with a front shaped edge and an enclosure means for a pull out tray;

b. a shelf unit located immediately above the first desktop and having spaced apart second and third vertical side panels that are connected to a second vertical back panel and a top panel; and c. a second desk unit having a file cabinet having spaced apart first and second file cabinet walls, a second desktop and a bookcase, the second desktop having spaced apart first and second ends, and spaced apart first and second sides, the first and second sides and the first end having first, second and third shaped edges, respectively, the first and second shaped edges extending from the first end along the first and second sides, respectively, and terminating at first and second squared edges of the first and second sides, respectively, the first and second squared edges extending further along the first and second sides, respectively, until terminating at first and second grooved sections of the first and second sides, respectively, the first and second grooved sections extending along the first and second sides until terminating at the second end of the second desktop, the second end and the first and second grooved sections of the second desktop being inserted into the bookcase, wherein the bookcase has first and second bookcase walls, a bookcase back wall, a bookcase top panel, and a rail that is attached to the inside surface of the bookcase back wall, the first and second bookcase walls being connected to the bookcase back wall and to the bookcase top panel, the second end of the second desktop being connected to the rail and the first end of the second desktop being placed upon the file cabinet.

9. The work station as in claim 8, wherein the first bookcase wall of the second desk unit is adjacent to the third vertical side panel of the shelf unit and the first vertical panel of the first desk unit, and the front shaped edge of the first desk unit and the first shaped edge of the second desk unit create a first shaped corner edge.

10. The work station as in claim 8, wherein the second bookcase wall of the second desk unit is adjacent to the second vertical side panel of the shelf unit and the outer side wall of the first cabinet, and the front shaped edge of the first desk unit and the second shaped edge of the second desk unit create a second shaped corner edge.

11. The work station as in claim 8, wherein the first cabinet has an electrical control panel.

12. The work station as in claim 8, wherein the first desktop has a hinged front panel for closing the enclosure means.

13. The work station as in claim 8, wherein the shelf unit has spaced apart second and third cabinets that are connected to the bottom surface of the top panel, the second and third cabinets being separated by an adjustable and removable shelf.

14. The work station as in claim 8, wherein the bookcase has a bookcase cabinet with an adjustable and removable bookcase cabinet shelf, the bookcase cabinet being located below the bookcase top panel and above the rail.

15. A work station comprising:

a. a first desk unit having a first desktop mounted on a first cabinet having an outer side wall, a first vertical side panel spaced apart from the first cabinet and a first vertical back panel that is connected to the rear surfaces of the first cabinet and the first vertical side panel, the first desktop having an enclosure means for a pull out tray, a hinged front panel for closing the enclosure means, and a top surface with a front shaped edge;

b. a shelf unit located immediately above the first desktop and having spaced apart second and third vertical side panels that are connected to a second vertical back panel and a top panel; and c. a second desk unit having a file cabinet having spaced apart first and second file cabinet walls, a second desktop and a bookcase, the second desktop having spaced apart first and second ends, and spaced apart first and second sides, the first and second sides and the first end having first, second and third shaped edges, respectively, the first and second shaped edges extending from the first end along the first and second sides, respectively, and terminating at first and second squared edges of the first and second sides, respectively, the first and second squared edges extending further along the first and second sides, respectively, until terminating at first and second indented sections of the first and second sides, respectively, the first and second indented sections extending along the first and second sides until terminating at the second end of the second desktop, the second end and the first and second indented sections of the second desktop being inserted into the bookcase, wherein the bookcase has spaced apart first and second bookcase walls, a bookcase back wall, a bookcase top panel, a bookcase cabinet, and a rail that is attached to the inside surface of the bookcase back wall and located below the bookcase cabinet, the first and second bookcase walls being connected to the bookcase back wall and to the bookcase top panel, the bookcase cabinet being attached to the bottom surface of the bookcase top panel, the second end of the second desktop being placed upon and connected to the rail and the first end of the second desktop being placed upon the file cabinet, the first bookcase wall of the second desk unit being adjacent to the third vertical side panel of the shelf unit and the first vertical side panel of the first desk unit, and the front shaped edge of the first desk unit and the first shaped edge of the second desk unit create a shaped corner edge.

16. A work station comprising:

a. a first desk unit having a first desktop mounted on a first cabinet having an outer side wall, a first vertical side panel spaced apart from the first cabinet and a first vertical back panel that is connected to the rear surfaces of the first cabinet and the first vertical side panel, the first desktop having an enclosure means for a pullout tray, a hinged front panel for closing the enclosure means, and a top surface with a front shaped edge;

b. a shelf unit located immediately above the first desktop and having spaced apart second and third vertical side panels that are connected to a second vertical back panel and a top panel; and c. a second desk unit having a file cabinet having spaced apart first and second file cabinet walls, a second desktop and a bookcase, the second desktop having spaced apart first and second ends, and spaced apart first and second sides, the first and second sides and the first end having first, second and third shaped edges, respectively, the first and second shaped edges extending from the first end along the first and second sides, respectively, and terminating at first and second squared edges of the first and second sides, respectively, the first and second squared edges extending further along the first and second sides, respectively, until terminating at first and second indented sections of the first and second sides, respectively, the first and second indented sections extending along the first and second sides until terminating at the second end of the second desktop, the second end and the first and second indented sections of the second desktop being inserted into the bookcase, wherein the bookcase has spaced apart first and second bookcase walls, a bookcase back wall, a bookcase top panel, a bookcase cabinet, and a rail that is attached to the inside surface of the bookcase back wall and located below the bookcase cabinet, the first and second bookcase walls being connected to the bookcase back wall and to the bookcase top panel, the bookcase cabinet being attached to the bottom surface of the bookcase top panel, the second end of the second desktop being placed upon and connected to the rail and the first end of the second desktop being placed upon and connected to the file cabinet, the second bookcase wall of the second desk unit being adjacent to the second vertical side panel of the shelf unit and the outer side wall of the first cabinet, and the front shaped edge of the first desk unit and the second shaped edge of the second desk unit create a shaped corner edge.

* * * * *

UNITED STATES PATENT AND TRADEMARK OFFICE

CERTIFICATE OF CORRECTION

PATENT NO. : 5,738,422

DATED : April 14, 1998

INVENTOR(S) : Earl Dalton Welborn, Jr., et al

It is certified that error appears in the above-indentified patent and that said Letters Patent is hereby corrected as shown below:

Delete Drawing Sheets 1-8, and substitute therefor the Drawing Sheets, consisting of FIGS. 1-8, as shown on the attached pages.

On the title page, item [56] relating to the References Cited, insert -- Hooker Furniture Corporation brochure No. 065-10-004, 005 and 006 for Decorator Group Computer Work Station, June, 1996. The design featured in this brochure is similar to the design claimed in the design patent application Serial No. 29/056,393 which was filed on June 17, 1996 and assigned to Hooker Furniture Corporation--.

Column 4, Line 4, after "into the sides", delete "64" and insert --64a--.

Column 6, Line 11, after "second sides", delete "64" and insert --64a--.

Column 6, Line 16, after "the sides", insert --64a and 65a--.

Column 6, Line 18, after "respectively", delete "64a and 65a".

Signed and Sealed this

Eighteenth Day of August, 1998

Bruce Lehman

*Attest:*

BRUCE LEHMAN

*Attesting Officer*

*Commissioner of Patents and Trademarks*